United States Patent [19]

Hara et al.

[11] 3,932,231

[45] Jan. 13, 1976

[54] METHOD OF MAKING SURFACE-COATED CEMENTED CARBIDE ARTICLES

[75] Inventors: Akio Hara; Shuji Yazu, both of Itami, Japan

[73] Assignee: Sumitomo Electric Industries, Ltd., Osaka, Japan

[22] Filed: Feb. 26, 1971

[21] Appl. No.: 119,134

[30] Foreign Application Priority Data

| | | |
|---|---|---|
| Mar. 5, 1970 | Japan | 45-18285 |
| Apr. 4, 1970 | Japan | 45-28739 |
| Apr. 18, 1970 | Japan | 45-33172 |
| Apr. 18, 1970 | Japan | 45-33173 |
| Aug. 7, 1970 | Japan | 45-69583 |
| Aug. 7, 1970 | Japan | 45-69584 |

[52] U.S. Cl. ..... 204/181

[51] Int. Cl.[2] ..... C25D 13/02

[58] Field of Search ..... 204/181

[56] References Cited

UNITED STATES PATENTS

| | | | |
|---|---|---|---|
| 2,894,888 | 7/1959 | Shyne | 204/181 |
| 3,475,161 | 10/1969 | Ramirez | 204/181 |

*Primary Examiner*—Howard S. Williams

*Attorney, Agent, or Firm*—Wenderoth, Lind & Ponack

[57] ABSTRACT

Surface-coated cemented carbide articles, in particular, cutting tools very excellent in wear resistance and heat resistance are made by an improved method according to the invention. This improved method comprises providing a 3–50 % by weight dispersion of fine powders of 20 microns or less containing 50 % or more of titanium carbide in a liquid consisting mainly of an organic solvent, applying a DC voltage of 10–500 volts to the surface of tungsten carbide base cemented carbides containing 4–30 % of a binder metal in said dispersion to thus cause electrophoretic deposition of the fine powders thereon, heating the coated surface at a temperature of 1260–1550 °C in vacuum or in a reducing or inert atmosphere and thereby forming a coating layer consisting mainly of titanium carbide of 100 microns or less on the surface of the cemented carbides.

10 Claims, 6 Drawing Figures

INVENTORS
AKIO HARA and
SHUJI YAZU
BY Wenderoth Lind & Ponack
Attorneys

AKIO HARA and
SHUJI YAZU,
INVENTORS

BY Wenderoth, Lind & Ponack

Attorneys

AKIO HARA and
shuji Yazu,
INVENTORS

BY Wenderoth, Lind & Ponack
Attorneys

METHOD OF MAKING SURFACE-COATED CEMENTED CARBIDE ARTICLES

BRIEF SUMMARY OF THE INVENTION

This invention relates to tungsten carbide base cemented carbide articles or parts, in particular, cutting tools, having titanium carbide-containing coatings excellent in wear resistance and heat resistance and to a method of making such articles.

Cemented carbides are sintered products having a suitable toughness and containing one or more of metal carbides such as carbides of tungsten, titanium, columbium and tantalum, cemented by a metal from the iron group, preferably cobalt. In the case of using these cemented carbides as a cutting tool, it is an important problem to increase the wear resistance since the tool life depends on the wearing of its edge. Of late, cermets consisting of mainly titanium carbide excellent in heat resistance and wear resistance with molybdenum, cemented by nickel, have hitherto been developed. However, such titanium carbide base alloys lack generally sufficient toughness, as compared with the ordinary tungsten carbide base cemented carbides.

A number of proposals have thus been made to coat the cemented carbides with titanium carbide rich cemented carbide or titanium carbide, for example, by forming under pressure a titanium carbide-containing layer on the surface of a green compact of tungsten carbide base alloy and subsequently heating at a sintering temperature (Japanese Patent Publication No. 18046/1969), and by carrying out gaseous phase plating of titanium carbide using a mixed gas of hydrogen and methane containing titanium tetrachloride (U.S. Pat. No. 2,962,388, FP No. 1,525,512 and Swedish Pat. No. 318,167). In these methods, however, manufacturing difficulties are unavoidable. In particular, the latter method has another serious disadvantage that the apparatus for practising the same is necessarily complicated and expensive, and it takes a very long period of time to obtain a plating layer of more than 10 microns in thickness. In addition, as a method of coating high melting point metals, graphites and steels with titanium carbide base alloys, plasma melt spraying and electroplating are well known. In the method by melt spraying, the adhesive strength between a base member and coating layer and the strength of a coating layer are not sufficient. This method cannot be applied to base members of complex shape and, further, requires expensive apparatus. In the method by electroplating, on the other hand, carbide grains such as titanium carbide are deposited simultaneously with electroplating of a binder metal such as nickel, resulting in that the quantity of the binder metal in a coating is too much to be useful as a cutting tool.

Furthermore, the utilization of electrophoretic deposition has been proposed as disclosed in Japanese Patent Publication No. 8951/1963, U.S. Pat. No. 3,171,192 and "Journal of the Electrochemical Society", Vol. 109, No. 10, page 923–927. The invention of Japanese Patent Publication No. 8951/1963 is only directed to filling micropores of a sintered metal with a solid powder, while JES shows academic studies on the relation of current and voltage affecting the speed of electrodeposition in the electrophoretic deposition and so on. In the case of U.S. Pat. No. 3,171,192, carbide-free heavy metals are used as a base member or substrate and mixed powders of tungsten carbide and a binder metal from the iron group, corresponding to the composition of the ordinary tungsten carbide base cemented carbides, are used as a coating material. The thus obtained composite parts i.e. cutting tools and dies ordinarily have a diffusion layer (intermediate layer) of more than 25 microns between the coating layer and base member, which diffusion layer consists of intermetallic compounds of tungsten, cobalt, nickel, etc., which are very brittle. Therefore, these composite parts do not always satisfy the wear resistance, adhesive strength of coating layer and toughness.

The use of a dip coat bath which is made up of a solvent, organic binder and particles to be employed for forming the coating is disclosed in U.S. Pat. No. 3,475,161 but the adhesive strength of the coating obtained thereby is not satisfactory.

It is the general object of the invention to provide a novel method for making surface-coated cemented carbide articles having an excellent wear resistance and heat resistance, whereby the above mentioned disadvantages of the prior art are overcome.

It is another object of the invention to provide parts or cutting tools excellent in wear resistance and toughness, which have the characteristics of tungsten carbide base cemented carbides and titanium carbide base cemented carbides in combination.

It is a further object of the invention to provide an improved method for forming a hard coating consisting mainly of titanium carbide on a substrate of tungsten carbide base cemented carbides by utilizing electrophoresis.

It is a further object of the invention to provide surface-coated tungsten carbide base cemented carbide parts wherein the intrinsic toughness of tungsten carbide base cemented carbides is held.

Tungsten carbide base cemented carbide articles having surfaces prepared according to the invention are useful for many purposes, such as cutting tools, dies, valves, bearings and the like.

BRIEF DESCRIPTION OF THE DRAWING

The accompanying drawings are to illustrate the principle and merits of the invention in more detail.

DETAILED DESCRIPTION OF THE INVENTION

Figure 1:
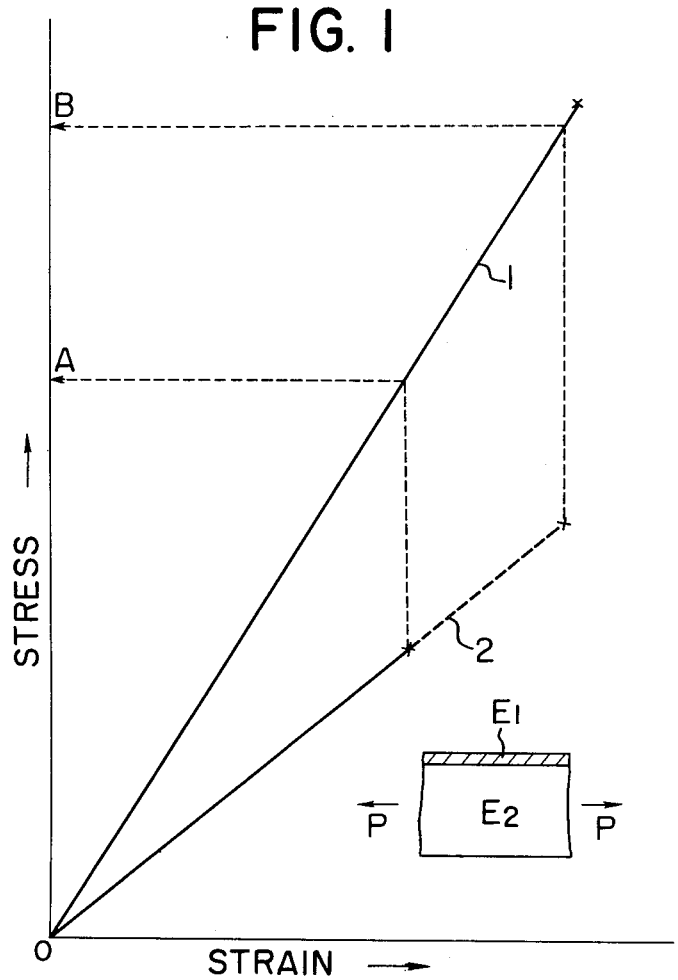
FIG. 1 is, for the purpose of illustrating the principle of the invention, a graph showing the relation of stress and strain of a base member of tungsten carbide base cemented carbides and coating layer of titanium carbide, where $E_1 > E_2$, $E_1$ being Young's modulus of the base member and $E_2$ being that of the coating layer when applying a force P to the composite part. Marks *x* show respectively broken points of the base member and coating layer. The vertical coordinate shows stress and the horizontal coordinate, strain.

We, the inventors, have found as a result of various studies to solve the disadvantages of the prior art that tungsten carbide base cemented carbides are coated with titanium carbide-containing fine powders by electrophoresis and heated whereby to obtain uniform and dense coating layers consisting mainly of titanium carbides, and reached the present invention.

That is to say, in accordance with the invention, there is provision of a method of making surface-coated cemented carbide articles, which comprises providing a 3–50 % by weight dispersion of fine powders of 20 microns or less containing 50 % or more of titanium carbide in a liquid consisting mainly of an organic solvent, applying a DC voltage of 10–500 volts to the surface of tungsten carbide base cemented carbides containing 4–30 % of a binder metal in said dispersion to thus cause electrophoretic deposition of the fine powders thereon, heating the coated surface at a temperature of 1260°–1550°C in vacuum or in a reducing or inert atmosphere and thereby forming a coating layer consisting mainly of titanium carbide of 100 microns or less on the surface of the cemented carbide.

As the fine powder having a particle size of 20 microns or less and containing 50 % or more of titanium carbide may preferably be used fine powders consisting of titanium carbide alone, and titanium carbide and 5–30 % of molybdenum and/or molybdenum carbide in combination, optionally with 1–30 % chromium carbide, vanadium carbide, tantalum carbide, columbium carbide, zirconium carbide, hafnium carbide and substances forming these carbides under the reaction conditions. Combinations of titanium carbide with 1–50 % of one or more of these carbides may also be used. Particularly, finely divided mixtures of titanium carbide and 1–50 % of tantalum carbide and finely divided solid solution of the same are preferably used. Such fine powder is generally prepared by pulverizing and mixing a starting powder or powdered mixture of the foregoing composition by means of, for example, a ball mill so as to give an average grain size of 20 microns or less. As occasion demands, carbon powder may be added.

The resulting titanium carbide-containing fine powder is dispersed in a liquid consisting mainly of an organic solvent, preferably, alcohol such as ethyl alcohol, methyl alcohol or isopropyl alcohol, ketone such as methyl ethyl ketone or methyl isobutyl ketone, nitroparaffin such as nitromethane or nitroethane or halogenated hydrocarbon such as methylene chloride or trichloroethylene. An insert of tungsten carbide base cemented carbides is immersed, as one electrode, in the resulting dispersion and a direct current voltage of 10–500 volts is applied thereto thus electrophoretically depositing the fine powder on the surface of the insert. In this case, small amounts of proteins and resins, commonly used in the electrophoretic deposition technique, may be added in order to raise the adhesiveness of the fine powder electrophoretically deposited as well as the strength of the deposited layer itself.

In order to obtain a coating layer that is excellent in wear resistance and dense, which the invention aims, the titanium carbide-containing fine powder should have a grain size of 20 microns or less. The reason is that, when larger than 20 microns, not only it is difficult to hold the powder in a uniform suspended state in the dispersion during electrodeposition, but also the sintering property is bad and it is difficult to obtain a completely dense coating layer by heating after the electrophoretic deposition. As is well known, the voltage in the practice of electrophoretic deposition depends ordinarily upon $\zeta$ potential of an electrodepositing material in a dispersion medium, but there has been no study on electrophoresis of titanium carbide or compositions comprising mainly titanium carbide.

Now it is surprisingly found that a DC voltage of about 100 volts is sufficient enough to obtain a deposited layer consisting of or comprising titanium carbide and having a desired thickness when using a mixed solution of isopropyl alcohol and nitromethane as dispersion medium and adding 1 % of protein based on the weight of fine powder. This is extraordinarily low considering that a high voltage of 300 volts or higher is commonly used in such non-aqueous dispersion system. Electrodeposition of titanium carbide is made possible by the method of the invention.

In the electrophoretic deposition according to the invention, the amount of deposition is short at a voltage of lower than 10 volts whilst, at a voltage of higher than 500 volts, a relatively high dielectric constant of an organic solvent such as ethyl alcohol, methyl alcohol or isopropyl alcohol results in generation of gas on the surface of a deposited material, thus lowering the amount of deposition and degradating the quality of it.

The concentration of titanium carbide-containing fine powder in the dispersion during electrophoretic deposition is related to the uniform deposition or throwing power of the electrodeposition film and to degradation of the electrodeposition film due to aggregation of the powder in the dispersion medium. The dispersion concentration should preferably be within a range of 3–50 %, since the amount of deposition is short if less than that and the uniform electrodeposition and quality of the electrodeposition film cannot be held if more than that.

In the method of the invention, the cemented carbides after electrophoretic deposition are heated at a temperature of 1260°–1550°C in vacuum or in a reducing or inert atmosphere, whereby to bond strongly a deposited layer consisting of or comprising titanium carbide to the surface of the cemented carbides and to exude some binder metal, usually cobalt into this coating layer from the cemented carbides, resulting in a dense titanium carbide-containing coating layer. At a heating temperature of lower than 1260°C, sintering of the titanium carbide coating layer itself is not sufficient and the wear resistance is considerably low. This is related to the fact that the temperature at which the liquid phase of TiC—Co system appears is approximately 1260°C. That is, at a temperature of lower than this, there occurs no exuding of the binder metal from the cemented carbide base member, nor progress of sintering of the coating layer. When the heating temperature is raised, sintering of the coating layer gradually takes place and, at about 1350°C, a completely dense layer is obtained. When the heating temperature is higher than 1550°C, deterioration of the cemented carbide base member and deformation thereof may occur because the sintering temperature of the base member is ordinarily lower than that.

Figure 2:
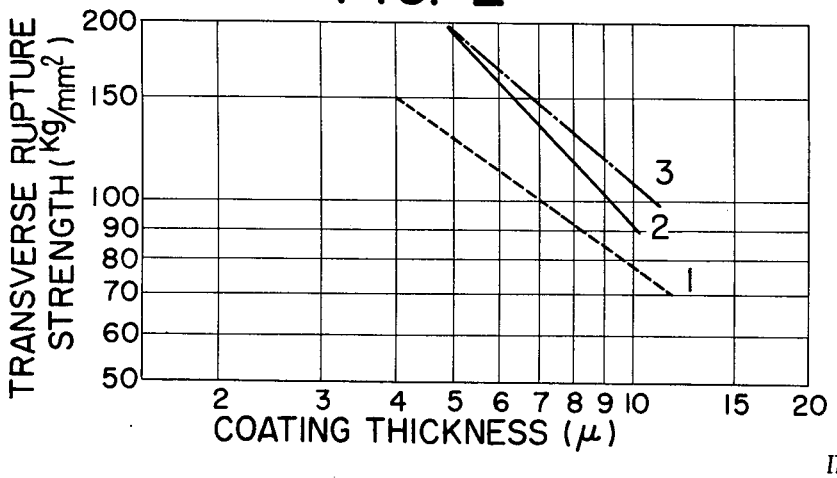
FIG. 2 is a graph showing the relation of coating thickness (horizontal coordinate, micron) and transverse rupture strength (vertical coordinate, kg/mm$^2$) of the composite part according to the invention.

The coating thickness may be varied with the object of use. When throw-away inserts for cutting are coated, a coating thickness of 3–30 micron is preferred. Progress of wearing of an insert is slow as the coating layer thickness increases, but the toughness of the insert itself sometimes lowers if too thick. When measurement of the transverse rapture strength (which will hereinafter be referred to as T.R.S. simply) of P 15 cemented carbides (67WC—26(TiC—TaC)—7Co) was carried out using a test piece of T.R.S. of cemented carbides (4 × 8 × 25 mm, JIS Standard), a base member not subjected to titanium carbide coating according to the invention gave 145 kg/mm$^2$, whilst a base member having a titanium carbide coating of about 5 microns prepared according to the invention gave 135 kg/mm$^2$ and similarly a base member having a coating of about 30 microns, 100 kg/mm$^2$. As shown in FIG. 2, using a test piece of T.R.S. (4 × 8 × 25 mm, JIS Standard) of P 30 cemented carbides (75WC—15-(TiC—TaC)—10Co) as a base member, there is also a difference of about 60 kg/mm$^2$ in the value of T.R.S. between the test pieces coated with titanium carbide alone (Curve 1) and with TiC-10$Mo_2C$—10TaC—10Ni (Curve 2) or with TiC—10$Mo_2C$—5$Cr_3C_2$—5-TaC—10Ni (Curve 3) at a coating thickness of 5 microns. In any case, the value of T.R.S. lowers considerably as the thickness of the coating layer increases. As is evident from these results, the coating layer should be made thinner as far as there is held a balance between the wear resistance and toughness, but a thicker coating may of course be allowed for uses where only the wear resistance is desired, for example, various guides. Where a wear resistance is desired without lowering the toughness of cemented carbides base member, in particular, one or more third components as mentioned above may be added.

Particularly preferred thickness of the coating layer may range from 3 to 30 microns and the thickness of larger than 100 microns should be avoided since it causes often cracks in the width of coating layer due to that, when heated at 1260°–1550°C after the electrophoretic deposition, the base member expands thermally while the coating layer sinters and thus shrinks.

When a substrate of tungsten carbide base cemented carbides is coated with a coating layer consisting of or comprising titanium carbide according to the method of the invention, the toughness of the substrate lowers somewhat, because of that the toughness of the coating layer is much lower than that of the substrate, as in hard chromium-plated steel articles, which toughness and fatigue strength lower. Therefore, one of desirable ways to raise the toughness of such composite articles is to make the toughness of a coating layer itself as high as possible. To illustrate this graphically, when $E_1 > E_2$ where $E_1$ is Young's modulus of a base member and $E_2$ is that of a coating layer, the relation of stress and strain thereof is obtained as shown in FIG. 1, in which Curve 1 is that of the base member and Curve 2 is that of the coating layer. The stress-strain curve is substantially linear since cemented carbides and carbide are taken into consideration. Moreover, it is assumed that the coating layer is thin enough and the strain thereof is restricted by the base member. In such case, application of a certain tensile load P creates different stresses on the coating layer and base member, that of the former being smaller. Therefore, even though the coating layer, if alone, is readily broken by a low stress, the load is shared with each other so that their strains may be equal and, consequently, the strength of the surface-coated article itself is considerably high. In case where the base member is of cemented carbides which breakage progresses due to brittleness, however, occurring of cracks on the coating layer (A) leads to breakage of the whole. Accordingly, if this break strength of the coating layer is further raised, the strength of the whole could substantially be the same as that of the base member, for example, as shown by B.

Tungsten carbide base cemented carbides used as a base member in the invention, containing 70–96 % by weight of tungsten carbide, have Young's modulus of 45–70 × 10$^3$ kg/mm$^2$, while titanium carbide gives 32 × 10$^3$ kg/mm$^2$ and carbides of molybdenum, vanadium, tantalum, columbium, zirconium, hafnium and chromium give less than 40 × 10$^3$ kg/mm$^2$.

The base member or substrate used in the invention consists of tungsten carbide base cemented carbides containing the system WC-Co or-other iron group metal, optionally with carbides of titanium, tantalum, columbium, hafnium, zirconium, chromium and vanadium. That is to say, the composition of this base member, which may be varied according to use, consists of 70–96 % tungsten carbide and 4–30 % cobalt or, if necessary, up to 50 % of said tungsten carbide being substituted by one or more of carbides of titanium, tantalum, columbium, hafnium, zirconium, chromium and vanadium. Other iron group metals than cobalt may be used including their alloys.

Since the base member of the invention is of cemented carbides consisting mainly of tungsten carbide as mentioned above, there is no foreign phase of boundary between the base member and coating layer consisting mainly of titanium carbide unlike in the case of U.S. Pat. No. 3,171,192 using carbide-free metals as the base member. This is possibly due to the fact that both the coating layer and base member have a sufficient carbon concentration necessary for forming a healthy carbide phase or desirable carbide-binder metal phase. In the method of gaseous phase plating of titanium carbide on the surface of cemented carbides also, a very brittle $\eta$ phase appears at boundary between a coating layer and base member and the toughness of the product is thus less than that of the invention.

In accordance with the method of the invention, composite parts or articles having a satisfactory wear resistance as well as toughness can be obtained even in the case of using titanium carbide powder alone for provision of the fine powder of 20 micron or less, but, depending on the use of parts or articles, a third material which will hereinafter be illustrated by way of example may be added to the above mentioned titanium carbide so as to obtain a desirable wear resistance and toughness. The coating layer formed consists mainly of titanium carbide, but is somewhat contaminated with foreign matters such as tungsten, cobalt and iron coming from the step of grinding the starting material and tungsten, cobalt, tantalum and columbium diffusing from the base member cemented carbides to the coating layer during the step of heating, even in the case of using titanium carbide powder only. In adding the third material, of course, it is additionally incorporated with similar contamination to give a more complicated composition.

As a preferred embodiment, powders containing titanium carbide and 5–30 % of molybdenum and/or molybdenum carbide are used as a starting material. In this case, the toughness and cutting property of the composite part are more improved as compared with the case of using titanium carbide alone. The reason is considered as follows. The electrophoretically deposited titanium carbide grains sinter during heating by aid of a binder metal exuding from the base member. The presence of molybdenum, as is well known, serves to improve markedly the wetting property of iron group metal to titanium carbide, whereby the grain size of titanium carbide during sintering is finely divided. If titanium carbide grains are fine, the hardness is raised.

The finer titanium carbide crystal grains are, the better the strength of sintered titanium carbide is. The effect by addition of molybdenum will be understood by this phenomenon. When less than 5 %, the above mentioned effect is not given and when more than 30 %, the wetting property is improved but excess molybdenum is dissolved in titanium carbide so that the most part of titanium carbide crystals are in the form of a solid solution of (Ti, Mo)C, not of TiC. This solid solution crystal has a lower hardness than that of titanium carbide, leading to lowering of the wear resistance.

As another embodiment, powders containing titanium carbide and 1–50 % of tantalum carbide are used as a starting material. In this case also, the cutting property of the product is more improved as compared with the case of using titanium carbide alone. The starting material may be prepared by mixing their powders or by providing a powdered solid solution of titanium carbide and tantalum carbide. It is found by experiments that the use of a powdered solid solution of the carbides gives better results, but their difference does not matter, in particular, considering additional costs for the previous provision of the solid solution. The basis for limiting the amount of tantalum carbide to 1–50 % lies in that, as evident from Example 6, in particular, Table 2, when less than 1 %, the effect by addition of tantalum carbide is not given and when more than 50 %, the wear resistance lowers. On the other hand, metallographical observation of the coating layer teaches that the tendency of fine division of titanium carbide grains is remarkable from about 10 % of tantalum carbide, from which an increase of toughness would be expected.

In a further embodiment are used, as a starting material, powders containing titanium carbide or titanium carbide and up to 30 % of molybdenum and/or molybdenum carbide, and 1–50 % of one or more of carbides of chromium, vanadium, tantalum, columbium, zirconium and hafnium and substances capable of forming these carbides under the reaction conditions, optionally with 1–30 % of nickel or cobalt. In this case, T.R.S. is considerably increased as compared with the case of using titanium carbide alone (FIG. 2), which is probably due to that gases such as oxygen and nitrogen in the titanium carbide are released by making a solid solution with these carbides or growth of titanium carbide grains is suppressed by the presence of these carbides to thus raise the toughness. Particularly, it is preferred to use powders containing titanium carbide, 1–30 % of molybdenum and/or molybdenum carbide, 1–30 % of chromium and/or chromium carbide and 1–30 % of nickel. In this case, the toughness is further raised as compared with the case of using titanium carbide alone or titanium carbide and molybdenum carbide. The presence of chromium or chromium carbide may suppress growth of titanium carbide grains, which is particularly promoted with molybdenum or molybdenum carbide. If titanium carbide grains are fine, the hardness rises and the strength of the sintered alloy increases, as mentioned above. When more than 30 %, the toughness of titanium carbide lowers. Moreover, nickel can wet these carbides well to form a dense coating. Where chromium is added, in particular, chromium is also dissolved in the nickel to give a bonded phase excellent in heat resistance, but more than 30 % of nickel results in lowering of the wear resistance.

The following examples are given in order to illustrate the invention in detail without limiting the same.

EXAMPLE 1

A mixture of −200 mesh titanium carbide powder and 0.3 % of carbon powder was pulverized in isopropyl alcohol for 2 days, dried and 5 g of the powder mixture was dispersed in a mixed solution of 50 ml of methylene chloride, 30 ml of isopropyl alcohol and 20 ml of nitromethane. 0.1 g of prolamin was added and stirred for 10 hours. A nickel plate was used as anode and an insert of P 15 cemented carbides (12.7 mm square, 4.8 mm thickness) was held by a narrow copper wire as cathode. 100 volts direct current at 3 milliamperes was applied across the electrodes for 30 seconds to effect electrophoresis. The thus coated insert was dried in a drying furnace and held at 1400°C for 1 hour in a vacuum furnace ($10^{-2}$ mm Hg) thus obtaining a completely dense and uniform coating layer of about 20 microns.

Figure 3A:
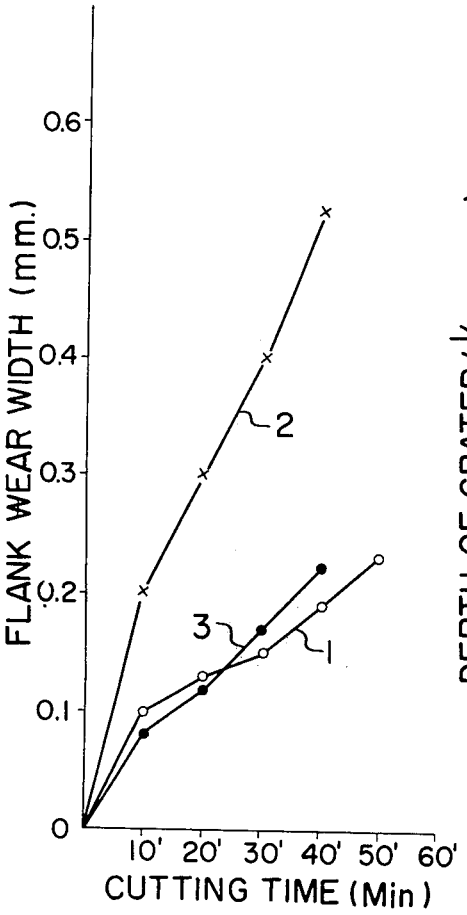
FIG. 3 and FIG. 4 are graphs showing the relation of cutting time (horizontal, minute) and flank wear (vertical, mm) or depth of crater (vertical, 1/100 mm) for comparison of the characters of the cutting tool according to the invention with those of the comparative cutting tools.
Figure 3B:
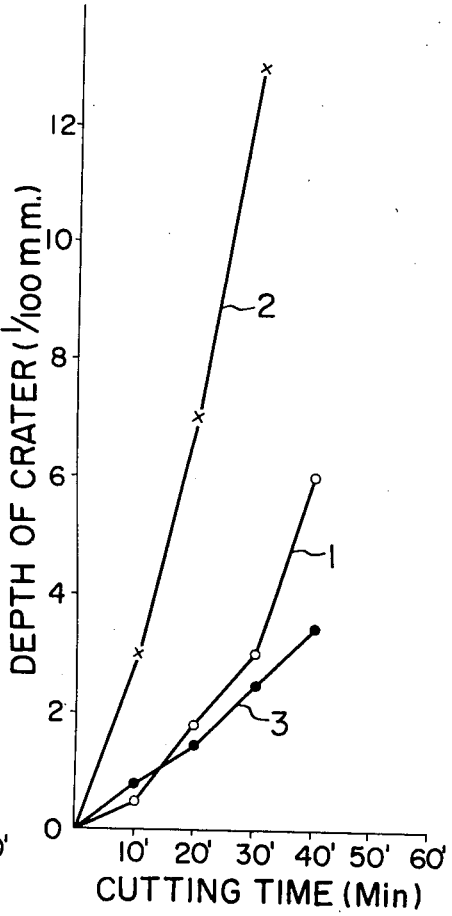
Figure 4A:
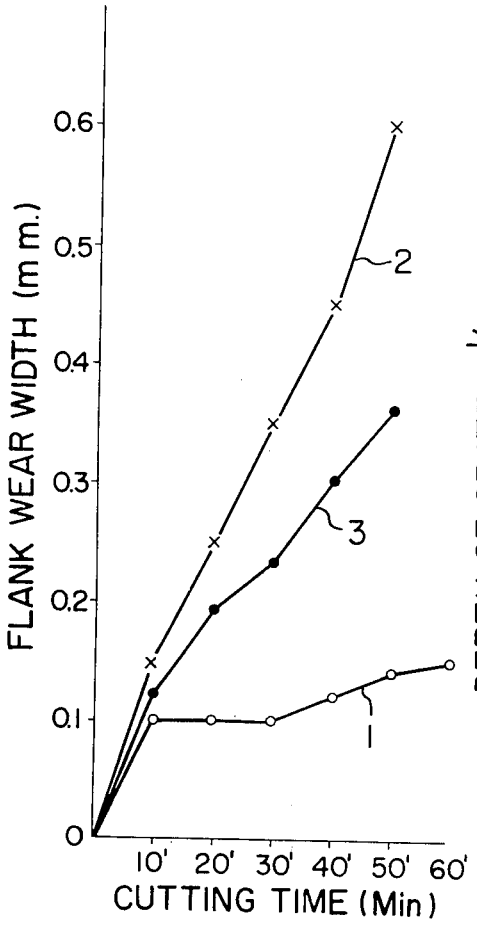
Figure 4B:
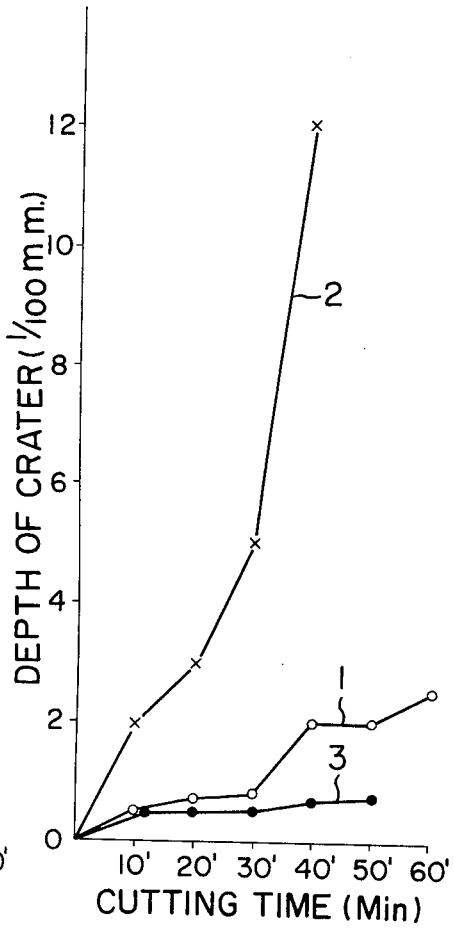

The resulting insert was then subjected to cutting test by the following conditions:

workpiece SK 5 (0.8–0.9 % C steel), cutting speed 110 m/min, depth of cut 2 mm, feed 0.37 mm/rev workpiece SCM 3 (steel containing 0.33–0.38 % C, 0.60–0.85 % Mn, 0.90 –1.2 % Cr, 0.25 % Ni, 0.15–0.30 % Mo), cutting speed 180 m/min, depth of cut 2mm, feed 0.24 mm/rev The results are shown in FIG. 3 and FIG. 4 (Curve 1), in which the flank wear (A, vertical, mm) and depth of crater (B, vertical, 1/100 mm) are shown respectively against the cutting time (A and B, horizontal, min). For comparison, other results are simultaneously shown obtained by the use of inserts of P 15 cemented carbides (Curve 2) and commercially sold titanium carbide base cermet (Curve 3) under the same conditions. As evident from FIG. 3 and FIG. 4, the effect of titanium carbide coating according to the invention about the flank wear and depth of crater is more remarkable as compared with that of coating-free insert.

When an insert of titanium carbide base cermet (TiC—13Ni—13Mo) was subjected to cutting test by the conditions of:

workpiece FC 25 (cast iron), cutting speed 150 m/min, depth of cut 2 mm, feed 0.258 mm/rev, the flank wear width was 0.35 mm, corresponding to wear due to chipping of the edge. On the contrary, the coated insert of P 15 cemented carbides according to the invention gave a normal wear mark, i.e. flank wear of 0.20 mm.

In an intermittent cutting test of S 50 (steel containing 0.50 % C), by means of a milling cutter, the coated insert according to the invention showed a substantially similar toughness to that of P 15 cemented carbides and was resistant to cutting conditions under which inserts of titanium carbide base cermet alone and P 10 cemented carbides (53WC—38(TiC—TaC)—9Co) alone were broken.

EXAMPLE 2

10 g of a mixture of −200 mesh titanium carbide powder and 0.2 % of carbon powder was dispersed in 100 ml of a mixed solution of 75 ml of methylene chloride and 25 ml of trichloroethylene. An insert of cemented carbide WC—5Ni was immersed as anode and 300 volt direct current at 0.5 milliampere was applied across the electrodes for 2 minutes. The thus coated insert was heated at 1375°C for 1 hour to obtain a uniform coating layer of about 17 microns in thickness. The surface of the coating was lapped by diamond paste and subjected to measurement of Vickers microhardness by a load of 200 g to give a hardness of 2500, while that of the base member being 1575.

EXAMPLE 3

A mixture of −50 mesh commercially sold titanium carbide powder and 0.3 % of carbon powder was ball-milled in acetone for 3 days. 5 g of the mixture was taken after dried and dispersed in a mixed solution of 95 parts of ethyl alcohol and 5 parts of water, to which 0.1 g of prolamin was then added with agitation. A stainless steel plate was used as anode and an insert of P 25 cemented carbides (75WC—13(Tic—Tac-)—12Co) (25.4 mm square, 4.8 mm thickness) was attached as cathode. 100 volts direct current at 50 milliamperes was applied across the electrodes for 20 seconds to effect electrophoresis. The thus coated insert was then heated at 1400°C for 1 hour in a vacuum furnace to obtain a coating layer of about 25 microns in thickness.

The resulting insert was then subjected to cutting test by the following conditions:

workpiece SK 5 (0.8–0.9 % C steel), cutting speed 80 m/min, depth of cut 2 mm, feed 0.40 mm/rev After the cutting operation for 10 minutes, the flank wear of the titanium carbide-coated insert was 0.09 mm, whilst that of the coating-free base member was 0.32 mm. The depth of crater of the former was 0.01 mm while that of the latter being 0.07 mm.

EXAMPLE 4

−200 mesh titanium carbide powder was ball-milled by wet process for 3 hours and dried. 10 g of the fine powder was taken and dispersed in a mixed solution of 50 ml of methylene chloride, 30 ml of isopropyl alcohol and 20 ml of nitromethane, to which 0.1 g of prolamin was then added followed by agitation for 3 hours. A nickel plate was used as anode and an insert of P 15 cemented carbides (12.7 mm square, 4.8 mm thickness) was held by a narrow copper wire as cathode. 200 volts direct current at 15 milliamperes was applied across the electrodes for 10 seconds to effect electrophoresis. The thus coated insert was dried and held at 1375°C for 1 hour in a vacuum furnace ($10^{-2}$ mmHg) thus obtaining a completely dense and uniform layer of about 17 microns in thickness.

The resulting insert was then subjected to cutting test by the following conditions:

workpiece SK 5, cutting speed 110 m/min, depth of cut 2 mm, feed 0.36 mm/rev

After the cutting operation for 10 minutes, the flank wear and depth of crater of the coated insert were respectively 0.07 mm and 0.010 mm, whilst those of the coating-free base were 0.20 mm and 0.030 mm.

Under the conditions of cutting speed 150 m/min and feed 0.25 mm/rev, the coated insert gave, after the cutting operation for 10 minutes, a flank wear of 0.16 mm and depth of crater of 0.04 mm, whilst the coating-free base member was broken in 8 minutes.

When an insert of titanium carbide base cermet (TiC—13Ni—13Mo) was subjected to cutting test by the conditions of:

workpiece FC 25, cutting speed 150 m/min, depth of cut 2 mm, feed 0.258 m/rev, the flank wear was 0.35 mm, corresponding to wear due to chipping of the edge. On the contrary, the coated insert of P 15 cemented carbides according to the invention gave a normal wear mark, i.e. flank wear of 0.20 mm under the same conditions.

In an intermittent cutting test of S 50 C by means of a milling cutter, the coated insert according to the invention showed a substantially similar toughness to that of P 15 cemented carbides and was resistant to cutting conditions under which an insert of cermet alone was broken.

EXAMPLE 5

A mixture of −200 mesh titanium carbide and molybdenum and/or molybdenum carbide powders having the composition as shown in Table 1 was pulverized and mixed in isopropyl alcohol for 2 days. After drying, 5 g of the mixture was taken and dispersed in a mixed solution of 50 ml of methylene chloride, 30 ml of isopropyl alcohol and 20 ml of nitromethane, to which 0.1 g of prolamin was added followed by stirring for 10 hours. A nickel plate was used as anode and an insert of P 15 cemented carbides (12.7 mm square, 4.8 mm thickness) was held by a narrow copper wire as cathode. 100 volts direct current at 3 milliamperes was applied across the electrodes for 30 seconds to effect electrophoresis. The thus coated insert was then dried in a drying furnace and held at 1400°C for 1 hour in a vacuum furnace ($10^{-2}$ mmHg).

The resulting coated insert was then subjected to cutting test by the following conditions:

workpiece SK 5, cutting speed 140 m/min, depth of cut 2 mm, feed 0.36 mm/rev, cutting time 20 minutes The results are shown in Table 1. It will apparently be understood that the wear resistance is excellent, in particular, within a range of 5–30 %. Moreover, in view of the chipping states of cutting edge and others during the cutting operation, addition of molybdenum and/or molybdenum carbide is somewhat effective.

Table 1

| Powder Composition | | | Quantity of Wear by Cutting | |
|---|---|---|---|---|
| TiC | $Mo_2C$ | Mo | flank wear width mm | depth of crater mm/100 |
| 100 | 0 | 0 | 0.45 | 4 × 1/100 |
| 100 | 5 | 0 | 0.30 | 3 |
| 100 | 2 | 0 | 0.32 | 3 |
| 100 | 10 | 0 | 0.27 | 2 |
| 100 | 20 | | 0.25 | 3 |
| 100 | 5 | 20 | 0.29 | 4 |
| 100 | 30 | | 0.32 | 4 |
| 100 | 0 | 40 | 0.40 | 5 |
| 100 | 50 | 0 | 0.60 | 6 |

EXAMPLE 6

−200 mesh titanium carbide and tantalum carbide powders were mixed in various compositions as shown in Table 2 and ball-milled by wet process for 50 hours to thus obtain mixed fine powders having an electron-microscopic particle size of 1.3 microns. 5 g of each of these mixed powders was dispersed in a mixed solution of 50 ml of methylene chloride, 20 ml of nitromethane and 30 ml of isopropyl alcohol, to which 0.1 g of prolamin was added followed by stirring for 10 hours. A nickel plate was used as anode and an insert of P 15 cemented carbides (12.7 mm square, 4.8 mm thickness) was held by a narrow copper wire as cathode. 100 volts direct current at 3 milliamperes was applied across the electrodes for 30 seconds to effect electrophoresis. The thus coated insert was dried in a drying furnace and held at 1400°C for 1 hour in a vacuum furnace ($10^{-2}$ mmHg).

The resulting coated insert was then subjected to cutting test by the following conditions:

workpiece SK 5, cutting speed 140 m/min, depth of cut 2 mm, feed 0.36 mm/rev, cutting time 20 minutes The results are shown in Table 2, from which it is evident that the effect by addition of tantalum carbide appears about 5 % and, when more than 50 %, the wear resistance rather lowers. On the other hand, the toughness of the coating layer could not be made clear by the cutting test, but it is considered to be raised by the metallographical observation that titanium carbide grains become fine when tantalum carbide, in particular, of about 10 % is added.

Table 2

| Powder Composition TiC | TaC | Quantity of Wear by Cutting flank wear width mm | depth of crater mm/100 |
|---|---|---|---|
| 100 | 0 | 0.45 | 4 × 1/100 |
| 97.5 | 2.5 | 0.42 | 4 |
| 95 | 5 | 0.31 | 3 |
| 90 | 10 | 0.25 | 3 |
| 85 | 15 | 0.23 | 2 |
| 75 | 25 | 0.23 | 3 |
| 65 | 35 | 0.27 | 3 |
| 50 | 50 | 0.30 | 4 |
| 35 | 65 | 0.55 | 5 |

EXAMPLE 7

Starting powders were mixed by the following recipe:

| | |
|---|---|
| −200 mesh titanium carbide powder | 70 % |
| −325 mesh molybdenum carbide powder | 10 % |
| −200 mesh tantalum carbide powder | 10 % |
| −325 mesh nickel powder | 10 % |
| carbon powder | 0.5 % |

The powder having the foregoing composition was pulverized and mixed in isopropyl alcohol for 2 days. After drying, 5 g of the powder was taken and dispersed in a mixed solution of 50 ml of methylene chloride, 30 ml of isopropyl alcohol and 20 ml of nitromethane, to which 0.1 g of prolamin was then added followed by agitation for 10 hours. A nickel plate was immersed as anode and an insert of P 30 cemented carbides (12.7 mm square, 4.8 mm thickness) was held by a narrow copper wire as cathode. 100 volts direct current at 3 milliamperes was applied across the electrodes for 10 seconds to effect electrophoresis. The thus obtained coated insert was dried in a drying furnace and held at 1400°C for 1 hour in a vacuum furnace ($10^{-2}$ mmHg), thus obtaining a completely dense and uniform layer of about 60 microns in thickness.

Similarly test pieces of T.R.S. by JIS Standard were coated with different thickness coating layers by varying the depositing time and sintered by heating. Measurement of their T.R.S. was carried out to give results as shown in FIG. 2.

The so obtained insert and an insert of P 30 cemented carbides for comparison were subjected to cutting test by the following conditions:

workpiece SCM 3, cutting speed 180 m/min, depth of cut 2 mm, feed 0.24 mm/rev, cutting time 10 minutes The composite insert of the invention gave a flank wear of 0.10 mm and depth of crater of 0.01 mm, whilst the coating-free insert gave respectively 0.50 mm and 0.10 mm.

Moreover, an intermittent cutting test by means of a milling cutter showed that the composite insert according to the invention had substantially the same toughness as that of the base member, P 30.

EXAMPLE 8

Starting powders were prepared by the following recipe:

| | |
|---|---|
| −200 mesh titanium carbide powder | 70 % |
| −325 mesh molybdenum carbide powder | 10 % |
| −325 mesh chromium carbide powder | 5 % |
| −200 mesh tantalum carbide powder | 5 % |
| −325 mesh nickel powder | 10 % |
| carbon powder | 0.6 % |

The powder having the foregoing composition was pulverized and mixed in isopropyl alcohol for 2 days. The other procedures were similar to those of Example 7. Test pieces of T.R.S. according to JIS Standard consisting of P 30 cemented carbides were coated with different thickness coating layers and then subjected to measurement of T.R.S., thus obtaining the results as shown in FIG. 2.

EXAMPLE 9

Test pieces of T.R.S. according to JIS each having a coating layer of 5 microns in thickness having a composition as shown in Table 3 and each consisting of P 30 cemented carbides were prepared by the similar manner to that of Example 7 and their T.R.S. values were measured.

Table 3

| No. | TiC | $Mo_2C$ | $Cr_3C_2$ | VC | TaC | NbC | ZrC | HfC | T.R.S. |
|---|---|---|---|---|---|---|---|---|---|
| 1 | 80 | 10 | 10 | | | | | | 160 |
| 2 | 80 | 10 | | 10 | | | | | 175 |
| 3 | 80 | 10 | | | 10 | | | | 150 |
| 4 | 80 | 10 | | | | 10 | | | 140 |
| 5 | 90 | | | | | | 10 | | 130 |
| 6 | 90 | | | | | | | 10 | 135 |
| 7 | 100 | | | | | | | | 125 |

EXAMPLE 10

Starting powders were prepared by the following recipe:

| | |
|---|---|
| −200 mesh titanium carbide powder | 81 % |

-continued

| | |
|---|---|
| −200 mesh molybdenum carbide powder | 7 % |
| −200 mesh chromium carbide powder | 5 % |
| −325 mesh nickel powder | 7 % |
| carbon powder | 0.6 % |

The foregoing powder mixture was pulverized and mixed in isopropyl alcohol for 2 days. After drying, 5 g of the powder was taken and then dispersed in a mixed solution of 50 ml of methylene chloride, 30 ml of isopropyl alcohol and 20 ml of nitromethane, to which 0.1 g of prolamin was then added followed by agitation for 10 hours. A nickel plate was immersed as anode and an insert of P 30 cemented carbides (12.7 mm square, 4.8 mm thickness) was held by a narrow copper wire as cathode. 100 volts direct current at 3 milliamperes was applied across the electrodes for 15 seconds to effect electrophoresis. The thus coated insert was dried in a drying furnace and held at 1400°C for 1 hour in a vacuum furnace ($10^{-2}$ mmHg).

The so obtained insert and inserts of coating-free P 20 cemented carbides (70 WC—24(TiC—TaC-)—6Co) and P 30 cemented carbides each having the same size as that of the former, for comparison, were subjected to cutting test by the following conditions:

workpiece SCM 3 (width 50 mm, length 300 mm), cutting speed 120 m/min, depth of cut 3 mm, feed per edge 0.45 m/rev milling cutter of one insert.

When comparison was carried out at the stage of a whole cut length of 5 meters, the P 20 insert was scarcely able to keep up cutting due to much chipping, the P 30 insert gave a flank wear width of 0.30 mm and the composite insert according to the invention, being completely free from tipping, gave a flank wear width of 0.12 mm.

It will be understood that the composite insert of the invention has more excellent characters in comparison with the commonly used tungsten carbide base cemented carbides.

EXAMPLE 11

A powder mixture having the following composition was used as a starting material.

| | |
|---|---|
| −200 mesh titanium carbide powder | 60 % |
| −200 mesh molybdenum carbide powder | 15 % |
| −200 mesh chromium carbide powder | 15 % |
| −325 mesh nickel powder | 10 % |
| carbon powder | 0.6 % |

An insert of P 30 cemented carbides was coated in the similar manner to that of Example 10 and, after cutting tests, the similar results were given to those of Example 10.

What is claimed is:

1. A method of making surface-coated cemented carbide articles, which comprises providing a 3–50% by weight dispersion of fine powders of 20 microns or less containing 50% or more of titanium carbide in a liquid consisting mainly of an organic solvent, immersing a tungsten carbide base cemented carbide article containing 4–30% of a binder metal in the dispersion, applying a direct current voltage of 10–500 volts to the surface of the tungsten carbide base cemented carbide article to cause electrophoretic deposition of the fine powders of the dispersion thereon, heating the coated surface at a temperature of 1260°–1550°C in a vacuum or in a reducing or inert atmosphere and thereby forming a coating layer on the surface consisting mainly of titanium carbide of 100 microns or less on the surface of the cemented carbides.

2. The method of claim 1 wherein said fine powder is a fine powder of titanium carbide or titanium carbide and up to 30% of at least one material selected from the group consisting of molybdenum and molybdenum carbide, and 1–50% of at least one compound selected from the group consisting of chromium carbide, vanadium carbide, tantalum carbide, columbium carbide, zirconium carbide and hafnium carbide.

3. The method of claim 1 wherein the fine powder further contains 1–30% of nickel or cobalt.

4. The method of claim 1 wherein said tungsten carbide base cemented carbides consist of 70–96 % tungsten carbide and 4–30 % cobalt.

5. The method of claim 4 wherein up to 50% of said tungsten carbide is substituted by at least one compound selected from the group consisting of titanium carbide, tantalum carbide, columbium carbide, hafnium carbide, zirconium carbide, chromium carbide and vanadium carbide.

6. The method of claim 1 wherein said fine powder is a fine powder of titanium carbide.

7. The method of claim 1 wherein said fine powder is a fine powder of titanium carbide and 5–30 % of at least one material selected from the group consiting of molybdenum and molybdenum carbide.

8. The method of claim 2 wherein said fine powder is a fine powder of solid solution of titanium carbide and 1–50 % tantalum carbide.

9. The method of claim 1 wherein said fine powder is prepared in the presence of free carbon fine powder.

10. The surface-coated cemented carbide articles produced by the method of claim 9.

* * * * *